United States Patent [19]

Sakuma

[11] 3,938,805

[45] Feb. 17, 1976

[54] GOLF ACCESSORY

[76] Inventor: Kei Sakuma, 10-Go, 14-Ban, 5-Chome, Sendagi, Bunkyo, Tokyo, Japan

[22] Filed: July 23, 1974

[21] Appl. No.: 491,665

[30] Foreign Application Priority Data

July 24, 1973 Japan ..... 48-87624[U]
Dec. 9, 1973 Japan ..... 48-144466[U]

[52] U.S. Cl. ..... 273/32 A; 224/5 C; 273/162 D; 46/DIG. 001

[51] Int. Cl.[2] ..... A63B 57/00

[58] Field of Search ..... 273/32, 162 D, 35; 46/DIG. 001; 224/5 C

[56] References Cited

UNITED STATES PATENTS

| | | | |
|---|---|---|---|
| 2,246,984 | 6/1941 | Palmer | 46/DIG. 001 |
| 3,032,345 | 5/1962 | Lemelson | 46/DIG. 001 |
| 3,199,873 | 8/1965 | Surratt | 46/DIG. 001 |
| 3,233,802 | 2/1966 | Ludwick | 273/32 A |
| 3,266,804 | 8/1966 | Carter | 46/DIG. 001 |
| 3,316,669 | 5/1967 | Nachbar | 46/DIG. 001 |
| 3,405,408 | 10/1968 | Baker | 46/DIG. 001 |
| 3,849,840 | 11/1974 | Yamada et al. | 46/DIG. 001 |
| 3,895,797 | 7/1975 | Moore | 273/32 A |

*Primary Examiner*—George J. Marlo
*Attorney, Agent, or Firm*—Holman & Stern

[57] ABSTRACT

A golf accessory comprising a first element to be used as a green marker, a second element releasably supporting said first element, and a flexible thin sheet secured to the bottom surface of said second element, said flexible sheet having pressure-sensitive adhesive applied on its bottom surface on which adhesive-coated bottom is applied a release paper. In place of said flexible thin sheet, a base member having an upright flange may be secured to the bottom of the second element, said base member being covered on its bottom with pressure-sensitive adhesive. A release paper may be applied to the adhesive-coated bottom surface of said base member. Or alternatively, a flexible thin sheet may be secured to the bottom of said base member having the upstanding flange. Pressure-sensitive adhesive may thus be applied to the bottom of the bottom surface of the flexible thin sheet to which bottom a release paper is attached. The golf accessory as described may be attached to any desired location such as the grip end of a putter, golf shoes, belt or the like. When using the golf accessory of this invention, the green marker which is apt to be lost may be removed from the retainer means as necessary and put back after use.

7 Claims, 7 Drawing Figures

GOLF ACCESSORY

OBJECTS AND SUMMARY OF INVENTION

This invention relates to a golf accessory comprising in combination a green marker and its retainer means, and more particularly to a golf accessory comprising a green marker for marking the location of the ball to prevent the ball from being an obstacle to other players and a retainer means for holding the green marker when it is not in use.

Thin pieces made of woolen yarn or synthetic resin have heretofore been commonly used as green markers, but there have been no special means for storing the green marker, so that players had to put such markers in their pockets. However, as the players usually play the golf in light clothes in which the pockets are naturally few, the pockets are filled up with various items necessary for the golf play such as score cards, pencils, hankerchiefs, tees, balls and etc. Consequently, small items such as green markers are liable to get mixed with things in the pockets so that the players have often have difficulty in taking markers out of their pockets when necessary. This difficulty has caused not only a delay in the play but also loss of the green markers.

The present invention has for its object the provision of a golf accessory designed to eliminate the aforesaid drawbacks. According to the invention, a golf accessory in combination of a green marker and its retainer means is provided comprising a first element to be used as a green marker, a second element releasably holding said first element, and a flexible thin sheet secured to the bottom surface of said second element, said flexible sheet having pressure-sensitive adhesive applied on its bottom surface, a release paper being applied on said adhesive-covered bottom.

The first element to be used as a green marker and the second element for holding the first element are preferably formed of separable fastening materials such as are commercially available under the trademark of "Velcro" fastener or the like. Said separable fastening device is described in U.S. Pat. No. 3,009,235. Due to the easiness in fastening and detaching and the superior gripping properties, the aforesaid fastening means is particularly effective for use as the first element constituting a green marker of the golf accessory of this invention and the second element for holding the first element. The fastening means is so light in weight that there is virtually no possibility that the two parts of the fastening means may accidentally be separated, to whatever location the golf accessory of this invention may be attached by the pressure-sensitive adhesive. In addition, the first element or green marker formed of the separable fastening means has a good gripping relation with the putter green so that the need is eliminated for providing the marker with a projecting pin whereby the marker is inserted into the grass of the green.

Alternatively, the first element to be used as a green marker and the second element releasably holding the first element may be formed of thin sheet-like magnets. On this case, the easiness in detaching and fastening and gripping properties are also provided by the magnetic coupling power, although the handling easiness is not so great as the aforesaid separable fastening means.

The flexible thin sheet may be made of synthetic resin such as polyvinylchloride, treated paper such as synthetic resin-treated paper, or other flexible materials. What is essential is that the material should be water-proof, moistureproof, tough, and capable of being formed into a thin sheet or film. The flexible thin sheet may be provided on its upper side with a roughened surface to which the first and second elements of the golf accessory are firmly secured. The pressure-sensitive adhesive which is applied to the bottom surface of the flexible thin sheet may be any commercially available adhesives including linking type acrylic resinous, natural rubber type or synthetic rubber type adhesives. Whichever type adhesive may be used, it should be prepared so as to provide a proper adhesive power.

The release paper may be formed of any commercially available water and moisture proof material including synthetic film such as a polyethylene sheet or treated paper such as silicone-coated paper, so long as the release paper is of the nature which can be separated from the pressure-sensitive adhesive as described above.

According to an alternate embodiment of the golf accessory of this invention, in place of the flexible thin sheet, a base member having upright flange means extending therefrom may be secured to the bottom of said second element, said base member having pressure-sensitive adhesive applied to its bottom and the release paper being attached to said adhesive-covered bottom. Said upright flange means is located outward of the first element to be used as a green marker and the second element supporting said first element to thereby protect the two elements from outside interference which may possibly remove the first element from the second element. Said base member having upright flange means may be in the form of a concave tray or a generally circular plate having at least two upright projections extending therefrom. The base member may be of any suitable configuration to prevent outside interference and yet permit easy removal and attachment of the green marker. The upright flange means may be inwardly inclined to protect the green marker or outwardly inclined to facilitate the removal of the marker. The base member with upright flange means may be formed of synthetic resin, metal or the like, but is preferably made of synthetic resin because of its workability. The golf accessory according to this embodiment is used by being attached to a flat surface as the bottom of the base member is usually formed flat. However, the base member may not necessarily be flat. The upright flange means serves to protect said first element as a green marker and said second support element from any interference from the top and sides while the base member is firmly secured to the second element to prevent the deformation of the latter.

According to a further embodiment of the invention, a golf accessory is provided comprising a first element to be used as a green marker, a second element releasably supporting the first element, a base member having upright flange means and secured to the bottom of said second element, and a flexible thin sheet secured to the bottom of said base member, said flexible thin sheet having pressure-sensitive adhesive applied to its bottom and a release paper being applied to said adhesivecovered bottom of the flexible sheet. Since this form of golf accessory is provided with both the flexible sheet and the base member having upright flange means, it provides both of the aforesaid advantages that the golf accessory may be secured to even an irregular surface and that the first and second elements are protected from outside interference.

The golf accessory according to this invention may easily be attached to any location such as the grip end of a putter, caddie bag, belt, gloves or others after the release paper is removed. Thus, a green marker liable to be lost may be removed from its retainer means for use as necessary and put back after use. The golf accessory having a flexible thin sheet may be firmly attached to an irregular surface, while with a golf accessory having a base member with upright flange means, the green marker and its retainer piece are protected. Particularly, when the golf accessory is secured to the grip end face of the putter, the green marker and its retainer piece is prevented from being damaged by contact with the bottom of a caddie bag while the putter is placed in the bag.

BRIEF DESCRIPTION OF THE DRAWINGS

The present invention will now be described with reference to several embodiments illustrated in the accompanying drawings, it being understood, however, that the invention is not limited to the precise arrangements shown.

DESCRIPTION OF PREFERRED EMBODIMENT

Figure 1:
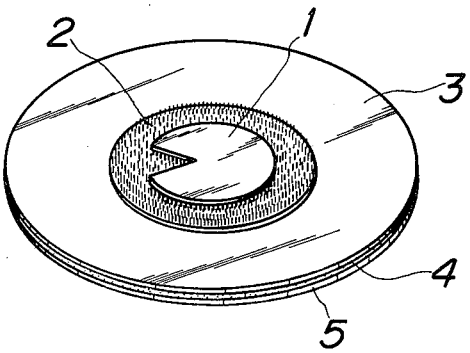
FIG. 1 is a perspective view of a golf accessory according to this invention.
Figure 2:
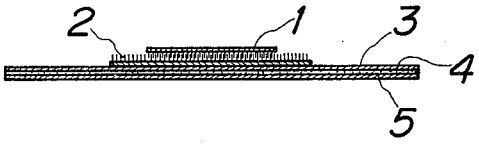
FIG. 2 is a vertical sectional view of the golf accessory of FIG. 1.

Referring to FIGS. 1 and 2, a green marker 1 is formed of a Velcro fastener (trademark) and a retainer piece 2 for holding the green marker is also made of the same material. The retainer piece 2 releasably supports the green marker 1. The bottom of the retainer piece is adhesively secured to a flexible thin sheet 3 of polyvinylchloride the bottom surface of which is coated with pressure-sensitive adhesive 4. Applied to said adhesive-coated bottom surface is a silicone-coated paper 5.

Figure 3:
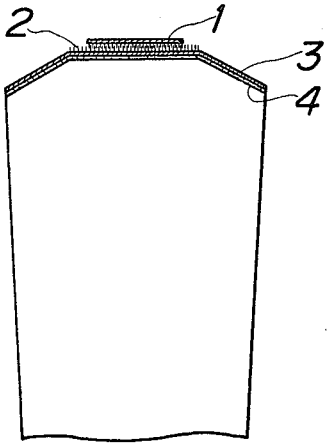
FIG. 3 is a vertical sectional view showing the golf accessory of FIG. 1 as being attached to the top grip end of a putter.

Reference is now made to FIG. 3. In use, the silicone-coated paper 5 is removed to expose the pressure-sensitive adhesive 4. The flexible thin sheet 3 with the pressuresensitive adhesive exposed is then pressed against the raised surface of the grip end such that the flexible sheet covers the entire raised surface.

It is preferable and convenient in use that the flexible thin sheet 3 is generally circular and dimensioned so as to extend beyond the outer periphery of the retainer piece 2. The green marker 1 is preferably of smaller size than the retainer piece 2 to facilitate the removal and attachment.

Figure 4:
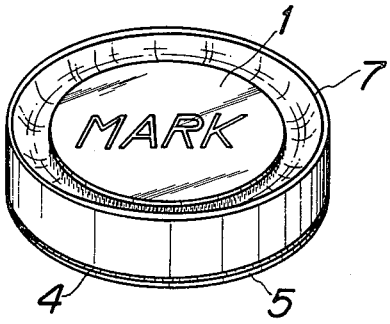
FIG. 4 is a perspective view of an alternate form of the golf accessory according to this invention.
Figure 6:
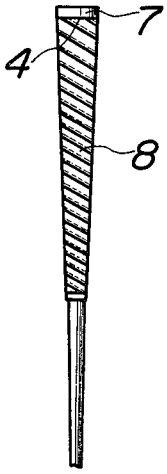
FIG. 6 is a side elevational view illustrating the accessory of FIG. 4 being secured to the top grip end of a putter.
Figure 5:
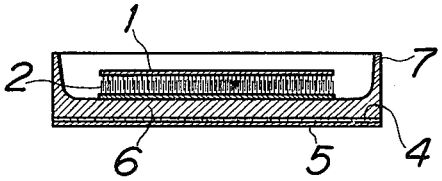
FIG. 5 is a vertical sectional view of the accessory of FIG. 4.

In FIGS. 4 through 7, the same parts as shown in FIGS. 1 to 3 bear the same reference numerals. Referring to FIGS. 4 and 5, a retainer piece or support member 2 releasably holding a green marker 1 is secured at its bottom surface to a base member 6 to the bottom of which pressure-sensitive adhesive is applied, a release paper 5 being attached to the adhesive-covered bottom of said base member. The base member is in the shape of a concave tray with an upright peripheral flange 7 extending therefrom. As shown in FIG. 6, in use the release paper 5 is removed and the golf accessory is fixed to the flat end face of the putter grip 8 by means of the adhesive-applied bottom of the base member. The golf accessory as illustrated in FIG. 4 to 6 protects the green marker 1 and its support member 2 from interference from the outside so that the green marker and its support member will not be subject to damage due to contact with the bottom of the caddie bag.

Figure 7:
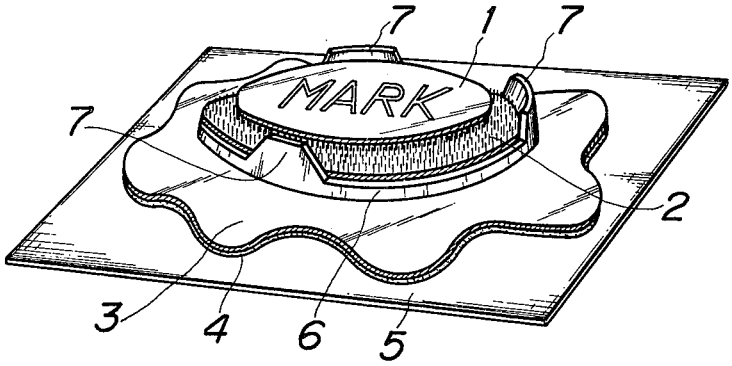
FIG. 7 is a perspective view of a further alternate form of the golf accessory according to this invention.

Still another embodiment of the golf accossory is illustrated in FIG. 7. A support member 2 of separable fastening material releasably holding a green marker 1 of the same material is bonded to a base member 6 having upright flange means 7 comprising, in this embodiment, three circumferentially spaced vertical projections extending from the periphery of the base member. Adhesively bonded to the bottom of the base member is a flexible thin sheet 3 having pressure-sensitive adhesive applied to its bottom. A release paper 5 is attached to the adhesive-applied bottom of the flexible sheet. The vertical projections 7 serve to protect the green marker from outside interference, and yet the spaces between the projections provides an easy access when the user removes the marker. The release paper 5 has a larger size than the flexible sheet 3 so that the release paper may easily be separated.

While the present invention has been described with reference to several preferred embodiments, it should be understood that the invention may be embodied in other specific forms without departing from the spirit thereof.

What I claim is:

1. A golf accessory comprising:
   - a green marker of a Velcro fastener material;
   - a retaining element of a Velcro fastener material for retaining said green marker;
   - a base member fixedly secured to said retaining element and having a protecting means for protecting said green marker from being accidentally brushed off when retained; and
   - an adhering means attached to said base member for adhering said base member to a suitable position comprising a layer of pressure-sensitive adhesive and a release paper attached thereto.

2. The golf accessory according to claim 1 wherein said base member is in the shape of a disc and said protecting means comprises an annular flange on the perimeter of said disc.

3. The golf accessory according to claim 2 wherein said adhering means is directly affixed to said base member.

4. The golf accessory according to claim 1 wherein said base member is in the shape of a disc having a face and said protecting means comprises at least two protrusions extending perpendicular to said face of said disc.

5. The golf accessory according to claim 4 wherein said adhering means is affixed to a thin flexible sheet, said thin flexible sheet being secured to said base member.

6. The golf accessory according to claim 1 wherein said adhering means is directly affixed to said base member.

7. The golf accessory according to claim 1 wherein said adhering means is affixed to a thin flexible sheet, said thin flexible sheet being secured to said base member.

* * * * *